United States Patent [19]

Oakland

[11] Patent Number: 4,883,436

[45] Date of Patent: Nov. 28, 1989

[54] KNEEBOARD WITH RETRACTABLE FINS

[75] Inventor: Dennis N. Oakland, Woodinville, Wash.

[73] Assignee: O'Brien International, Inc., Redmond, Wash.

[21] Appl. No.: 341,292

[22] Filed: Apr. 19, 1989

Related U.S. Application Data

[63] Continuation of Ser. No. 99,127, Sep. 21, 1987, abandoned.

[51] Int. Cl.[4] ..... B63B 41/00

[52] U.S. Cl. ..... 441/65; 441/74; 441/79; 114/132

[58] Field of Search ..... 114/39.2, 126, 132, 114/140, 141; 441/65, 68, 74, 75, 79

[56] References Cited

U.S. PATENT DOCUMENTS

| | | | |
|---|---|---|---|
| 3,066,327 | 12/1962 | Durfey . | |
| 3,082,444 | 3/1963 | Estes . | |
| 3,087,173 | 4/1963 | Meyer . | |
| 3,213,822 | 10/1965 | Sawchuk | 441/74 |
| 3,516,100 | 6/1970 | Ellis . | |
| 3,579,682 | 5/1971 | Wood | 441/65 |
| 4,302,858 | 12/1981 | Casciano | 441/65 |
| 4,439,166 | 3/1984 | Maxwell . | |
| 4,619,619 | 10/1986 | Muse | 441/79 |
| 4,708,675 | 11/1987 | Shoeffler et al. | 441/65 |
| 4,805,546 | 2/1989 | Geller et al. | 114/132 |

OTHER PUBLICATIONS

Catalog page for Magna Hydro Slide kneeboard.

*Primary Examiner*—Sherman D. Basinger
*Assistant Examiner*—Stephen P. Avila

[57] ABSTRACT

A kneeboard is provided with a pair of retractable fins which are operated by a control knob mounted on the board in front of the user's knees. The control knob is connected to the fins by a pair of cables. The fins can be raised or lowered simultaneously by sliding the control knob forwardly or rearwardly.

11 Claims, 5 Drawing Sheets

FIG. 4
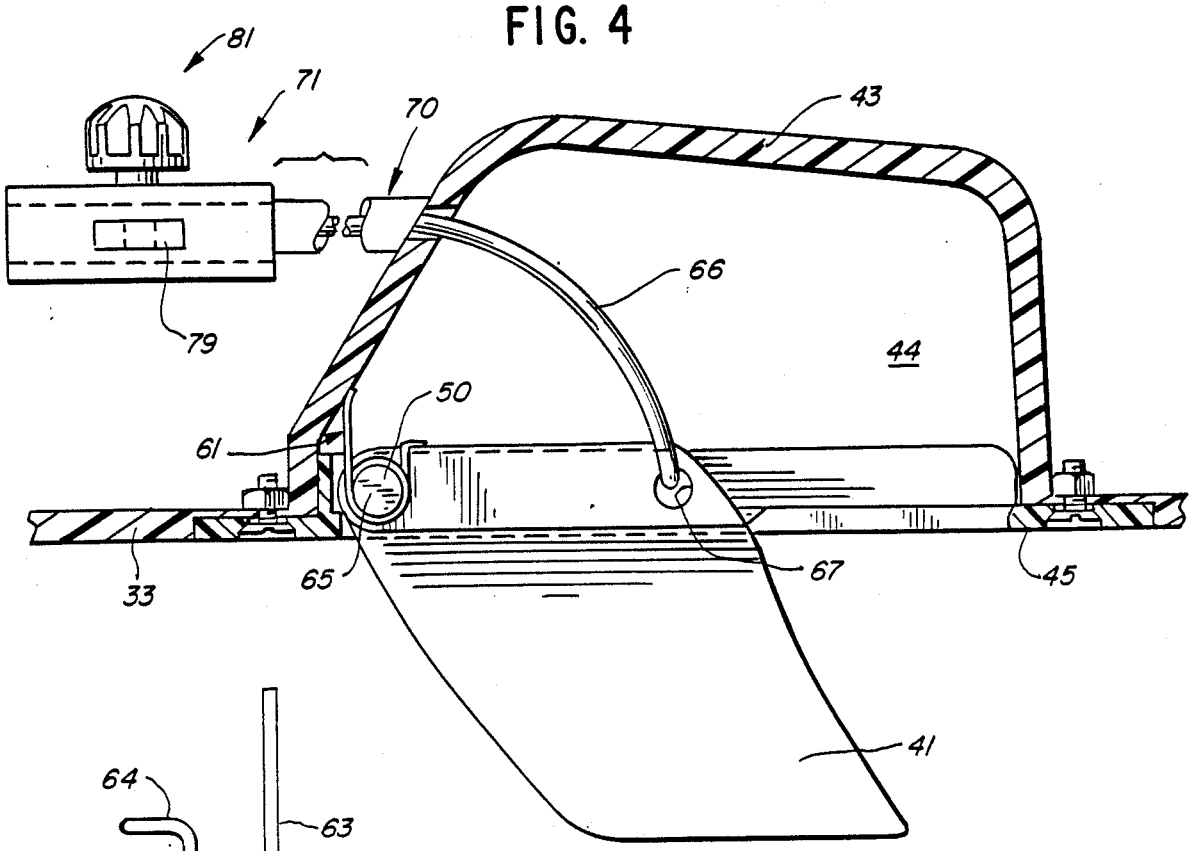
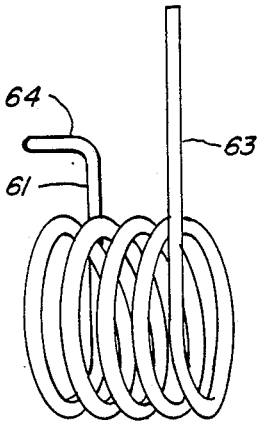
FIG. 6
FIG. 5
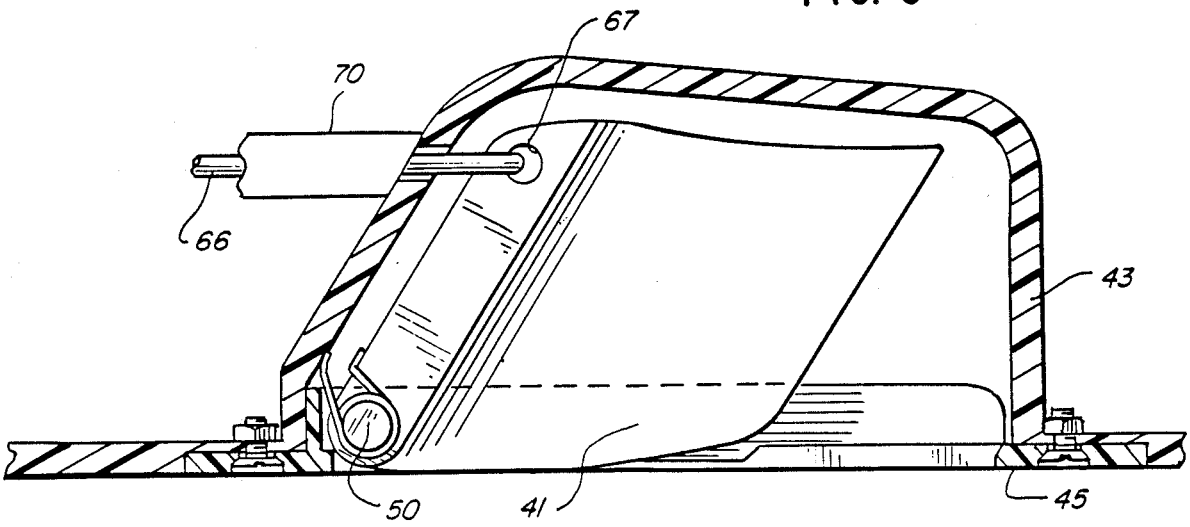

FIG. 8
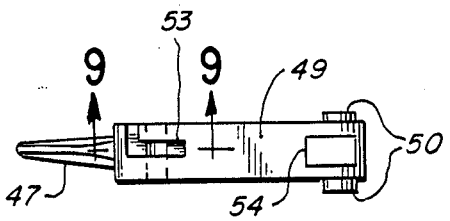
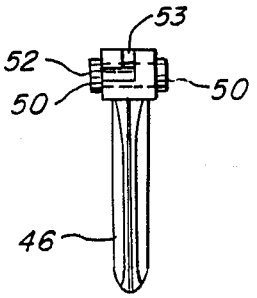
FIG. 11
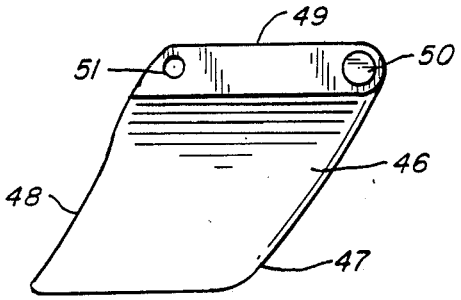
FIG. 7
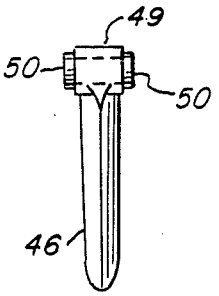
FIG. 10
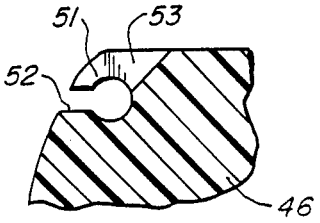
FIG. 9
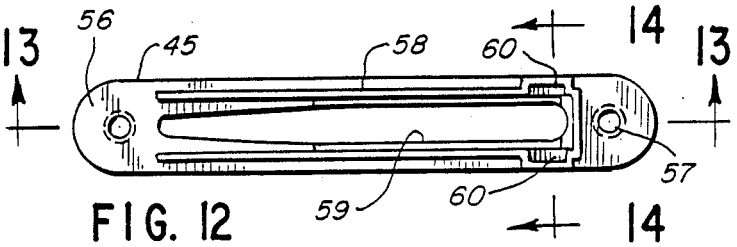
FIG. 12
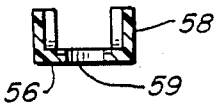
FIG. 14
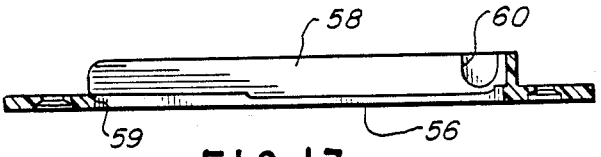
FIG. 13

FIG. 15
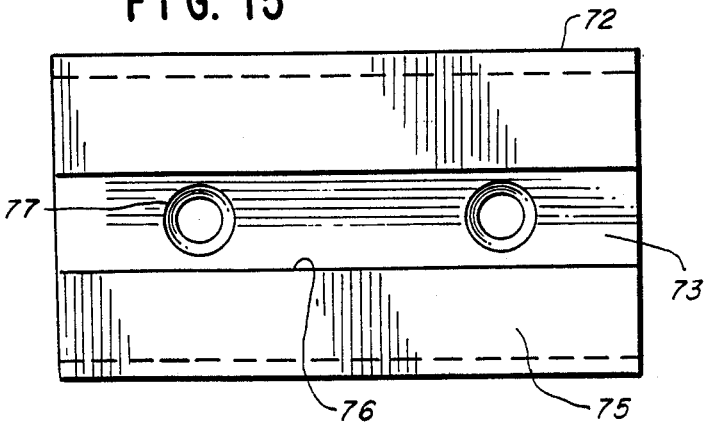
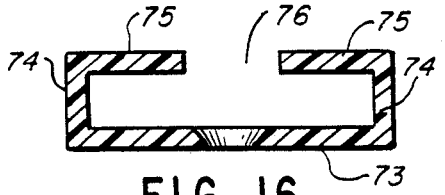
FIG. 16
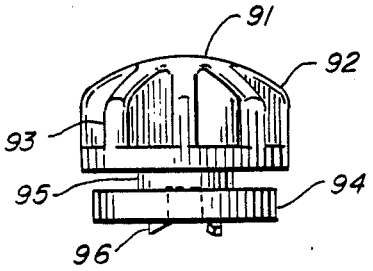
FIG. 23
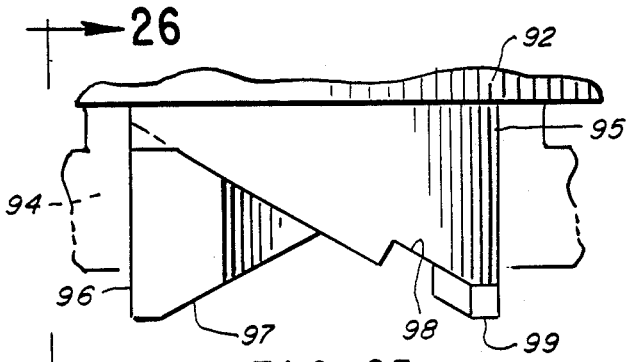
FIG. 25
FIG. 24
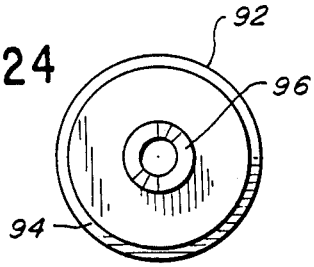
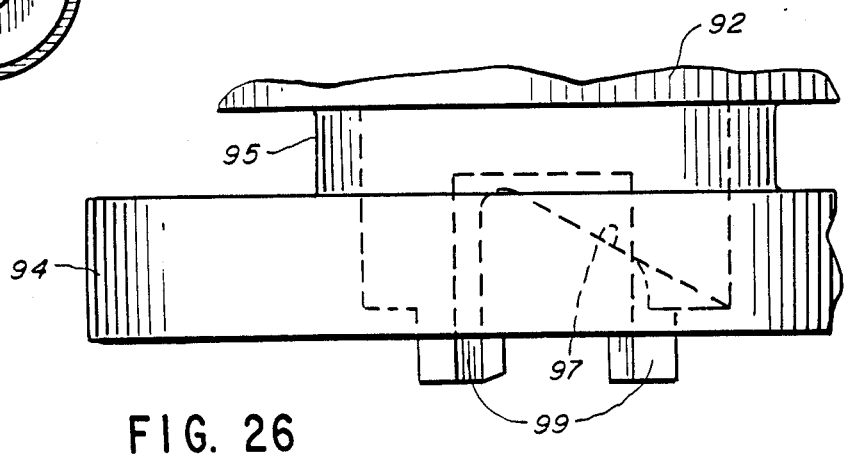
FIG. 26

KNEEBOARD WITH RETRACTABLE FINS

This application is continuation of application Ser. No. 099,127, filed Sept. 21, 1987 now abandoned.

BACKGROUND

This invention relates to kneeboards, and, more particularly, to a kneeboard which is provided with a pair of retractable fins which are operated simultaneously by a control knob in front of the user.

A kneeboard is essentially a short surfboard on which the user kneels. The user holds on to a tow rope with his legs strapped to the kneeboard, and the user is pulled over water by a power boat.

A kneeboard was initially considered an alternative to water skis which could be enjoyed without significant training or experience. Also, kneeboards do not need as powerful a motor boat. However, as the popularity of kneeboards grew, skilled participants began performing more difficult maneuvers such as slalom turns, wake jumping, 360's, and other tricks.

Certain maneuvers, such as 360's, are performed more easily on a kneeboard which has a relatively smooth bottom. Other maneuvers, such as slalom turns and wake jumping, are performed more easily on a kneeboard which has one or more fins which extend from the bottom surface.

Some kneeboards are equipped with removable fins. However, mounting or removing the fins requires the user to stop, put the board in the boat, and use a screwdriver or other tool to mount or remove the fins.

More recently, a kneeboard was introduced which includes two retractable fins. The fins can be raised or lowered while the user remains on the board. However, each fin is operated by a separate control knob which is located at the rear of the board. The user must reach behind his feet to adjust each control knob and might have to look back to accomplish the adjustment.

SUMMARY OF THE INVENTION

The invention permits a pair of retractable fins to be operated simultaneously by a single control knob which is located in front of the user between his knees. A pair of cables connect the control knob to each of the fins. The fins are pivotally mounted within the board, and sliding the control knob forwardly or rearwardly raises or lowers the fins.

DESCRIPTION OF THE DRAWING

The invention will be explained in conjunction with an illustrative embodiment shown in the accompanying drawing, in which

FIG. 4 is an enlarged fragmentary sectional view of a portion of FIG. 3;

FIG. 5 is a fragmentary view similar to FIG. 4 showing the fin in the raised position;

FIG. 6 is an elevational view of the spring which biases the fin;

FIG. 7 is a right side elevational view of one of the fins;

FIG. 8 is a top plan view of the fin;

FIG. 9 is an enlarged fragmentary sectional view taken along the line 9—9 of FIG. 8;

FIG. 10 is a front elevational view of the fin;

FIG. 11 is a rear elevational view of the fin;

FIG. 12 is a top plan view of one of the mounting brackets for the fins;

FIG. 13 is a sectional view taken along the line 13—13 of FIG. 12;

FIG. 14 is a sectional view taken along the line 14—14 of FIG. 12;

FIG. 15 is a top plan view of the slide channel for the control knob;

FIG. 16 is a sectional view taken along the line 16—16 of FIG. 15;

FIG. 23 is an elevational view of the control knob

FIG. 24 is a bottom plan view of the control knob;

FIG. 25 is an enlarged fragmentary view of the cam portion of the control knob; and FIG. 26 is a view of the cam portion taken along the line 26—26 of FIG. 25.

DESCRIPTION OF SPECIFIC EMBODIMENT

Figure 1:
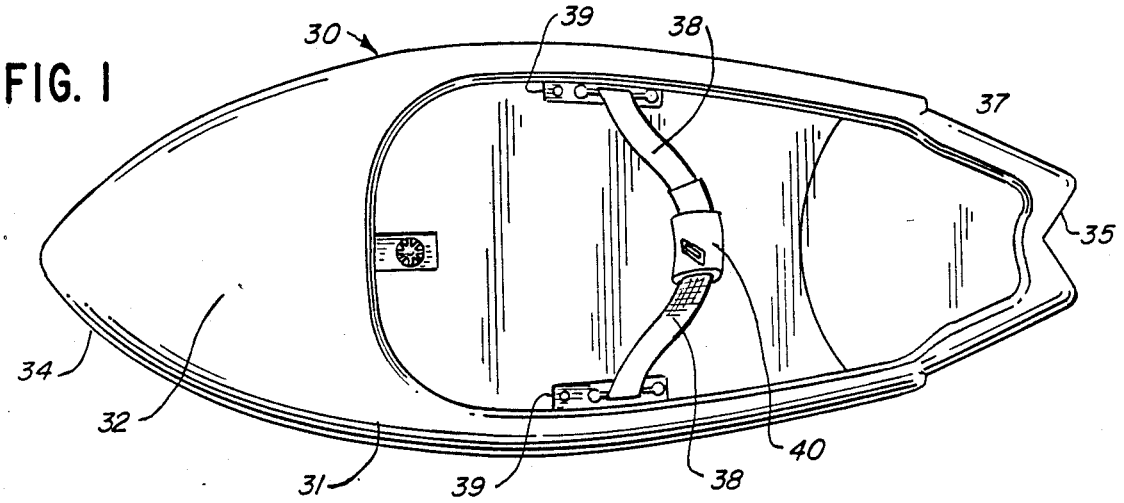
FIG. 1 is a top plan view of a kneeboard equipped with retractable fins in accordance with the invention.
Figure 2:
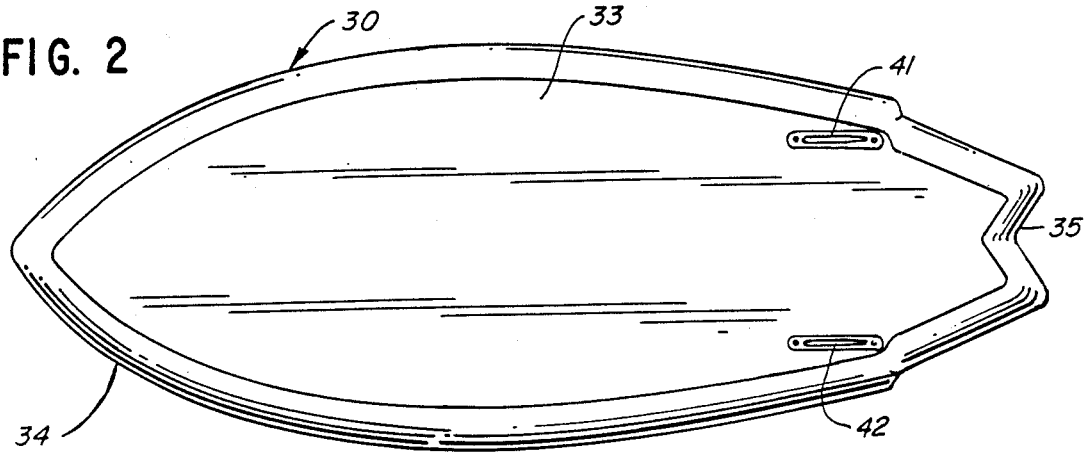
FIG. 2 is a bottom plan view of the kneeboard.
Figure 3:
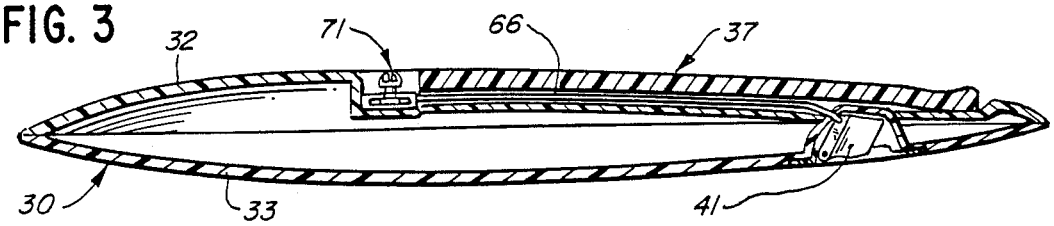
FIG. 3 is a longitudinal sectional view taken along the line 3—3 of FIG. 1.
Figure 17:
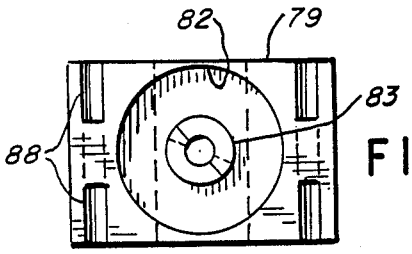
FIG. 17 is a top plan view of the cable slide.
Figure 19:
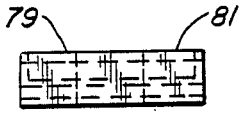
FIG. 19 is a side elevational view of the slide.
Figure 18:
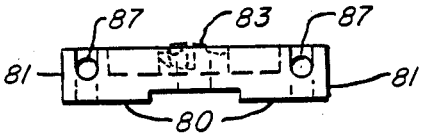
FIG. 18 is a front elevational view of the slide for the cables.

Referring to FIGS. 1-3, a kneeboard 30 includes an elongated body 31 which may be formed from top and bottom plastic shells 32 and 33 which are secured together around the side 33 of the body. The body has a tapered front end 34 and a somewhat blunter rear end 35. The bottom surface 36 of the body is relatively smooth and relatively flat, and a nylon kneeling pad 37 is positioned within a recess in the top shell 32 of the body. A pair of leg straps 38 are attached to the body by a pair of brackets 39 adjacent the sides thereof at about the longitudinal midpoint of the body. The straps are connected by a buckle 40 for adjusting the tension of the straps against the legs. Alternatively, one end of the strap can be secured to one of the brackets 39, and the other end can be looped around the other bracket 39 and secured by a Velcro pad.

Thus far the kneeboard is conventional, and the details thereof are well known. During use, the user kneels on the pad 37 so that his feet are adjacent the rear end 35 of the board. The board is attached to the user by tightening the straps 38 about his thighs above the knees. The user holds onto a tow rope and is pulled over a water surface by a power boat.

Referring now to FIGS. 2-5, a pair of retractable fins 41 and 42 are pivotally mounted within the body for movement between a lowered position (FIG. 4) and a raised position (FIG. 5). Each fin is mounted within a housing or skeg box 43 which is molded into the bottom shell 33 and which provides a fin pocket 44. A mounting bracket 45 is attached to the bottom shell below the fin housing and pivotally supports the fin.

The details of the fins are illustrated in FIGS. 7-10. Each fin includes a fin body 46 having a leading edge 47, a trailing edge 48, and a mounting portion 49. The front of the mounting portion includes a pair of laterally outwardly extending trunnions 50, and the rear of the mounting portion is provided with a transverse opening 51, a rearwardly opening slot 52, and an upwardly opening cable slot 53. A spring recess 54 is provided in the front of the mounting portion between the trunnions 50.

Each mounting bracket 45 includes a flat mounting plate 56 (FIGS. 12–14) which is provided with a pair of bolt holes 57 and a U-shaped upwardly extending side wall 58. The fin extend through a slot 59 in the mounting plate, and the trunnions 50 are rotatably supported and retained by a pair of U-shaped trunnion supports 60 in the side wall 58. The mounting portion 49 of the fin is slightly wider than the slot 59 in the mounting bracket so that the fin is prevented from pivoting downwardly beyond its lowered position shown in FIG. 4. The fin is resiliently biased toward its lowered position by a spring 61 (FIG. 6) which is positioned in the spring recess 54. The spring includes a coil 62 and a pair of legs 63 and 64. The spring is retained within the spring recess by a pin 65 which extends through the trunnions 50 and the coil 62. The legs of the spring engage the fin housing 43 and the wall of the spring recess, respectively.

Each fin can be retracted or raised by a cable 66 (FIG. 4). A bead 67 is secured to the end of the cable and is inserted through the opening 51 in the fin. The cable is inserted through the rear slot 52 (FIG. 9) in the fin and extends upwardly through the slot 53.

Each cable extends through a sheath or cable housing 70 which is secured to the fin housing 43 and which extends beneath the knee pad 37. The other end of each cable is controlled by a cable control apparatus 71. The cable control apparatus includes a channel-shaped bracket 72 which is secured to the top shell 32 of the kneeboard within the recess for the knee pad 37. Referring to FIGS. 15 and 16, the channel bracket 72 includes a bottom wall 73, a pair of upwardly extending side walls 74, and a pair of inwardly extending top walls 75 which are spaced-apart to provide a slot 76. The channel bracket 72 is secured to the top shell 32 of the kneeboard by screws which extend through screw holes 77 in the bottom wall 72.

Figure 21:
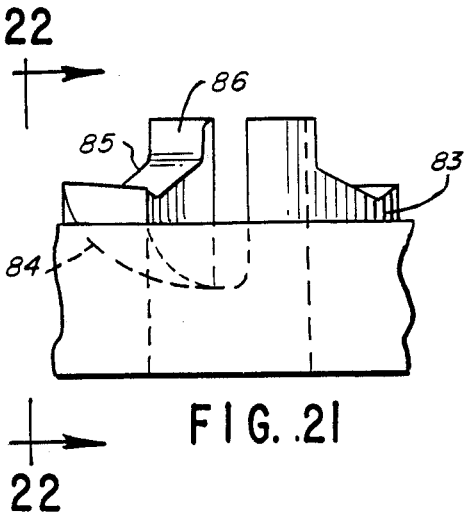
FIG. 21 is an enlarged fragmentary view of the cam portion of the slide.
Figure 20:
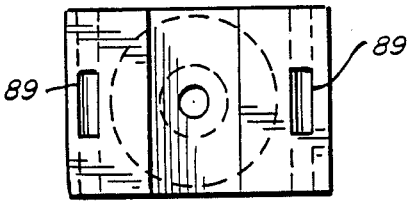
FIG. 20 is a bottom plan view of the slide.
Figure 22:
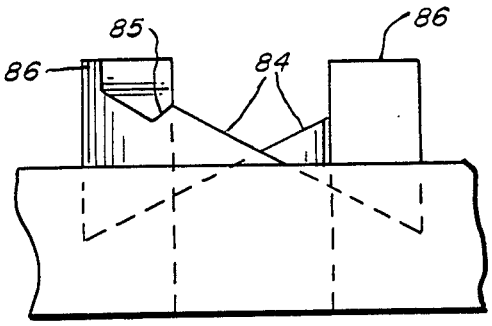
FIG. 22 is a view of the cam portion taken along the line 22—22 of FIG. 21.

Referring now to FIGS. 17–22, the two cables 66 which are attached to the fins 41 and 42 are connected to a cable slide 79 which is positioned within the channel bracket 72. The cable slide 79 includes a pair of spaced-apart legs 80 which engage the bottom wall 73 of the channel bracket and a pair of side walls 81 which slide between the side walls 74 of the channel bracket and which prevent rotation of the slide within the bracket. The top surface of the cable slide is provided with a cylindrical recess 82 and an upwardly extending annular cam 83. Referring to FIGS. 21 and 22, the cam 83 includes a pair of upwardly inclined camming ramps 84, a detent recess 85 at the upper end of each camming recess, and an upwardly extending stop wall 86.

A pair of cable holes 87 extend through the cable slide, and each of the cables 66 extends through one of the cable holes and is retained therein by a bead which is clamped to the end of the cable. The cable slide is advantageously injection molded, and the cable openings 87 are formed by the mold by providing a pair of recesses 88 in the top surface of the slide and a recess 89 in the bottom surface of the slide.

The cable slide 79 is locked in a desired position within the channel bracket 72 by a control knob 81 (FIGS. 23–26). The control knob includes a finger gripping portion 92 which is positioned above the channel bracket 72 and which includes a plurality of radially extending fins 93 which provide the finger gripping portion with a knurled surface. A disc portion 94 of the control knob is positioned below the top walls 75 of the channel bracket and is connected to the finger gripping portion by a cylindrical connecting portion 95 which extends through the slot 76 in the channel bracket.

An annular cam 96 extends downwardly from the disc portion 94. Referring to FIGS. 25 and 26, the cam 96 has a shape similar to the shape of the cam 83 of the cable slide and includes a pair of downwardly inclined camming ramps 97 which terminate in a detent recess 98 and a downwardly extending stop wall 99.

When the detent recesses 85 and 98 of the cams 83 and 96 are not engaged, the space between the top surface of the disc 94 of the operating knob and the bottom surfaces of the legs 80 of the cable slide are less than the height of the channel within the channel bracket, and the disc portion 94 and the cable slide 79 can slide freely within the channel bracket. However, when the operating knob is rotated, the cams 83 and 96 move the top surface of the disc portion 94 and the bottom surfaces of the legs 80 apart and bring them into frictional engagement with the top walls 75 and the bottom wall 73, respectively, of the channel bracket. When the operating knob is rotated sufficiently to lock the detent recesses 85 and 98 of the cams 83 and 96, respectively, the cable slide 79 is frictionally locked against the bottom wall 73 of the channel bracket and the cables 66 are fixed against further movement. The operating knob needs to be rotated only ¼ of a turn to lock the cable slide.

Referring to FIG. 4, when the operating knob and cable slide are positioned adjacent the rear end of the channel bracket 72, the fins 41 and 42 are biased by the springs 61 into their lowered position. When the operating knob and cable slide are moved fowardly to the front end of the channel bracket, the cables 66 pivot the fins upwardly on the trunnions 50 until the fins are retracted within the fin pocket 44 as illustrated in FIG. 5. The fins can be locked in their retracted positions by rotating the control knob 81. The fins can be locked in any desired intermediate position by moving the control knob to the desired position along the length of the channel bracket and rotating the knob to lock the cable slide. The cable sheath 70 is secured to the top shell 32 of the kneeboard, and movement of the front end of the cables is transmitted directly to the fins.

The two cables 66 are secured to a single cable slide, and both of the fins 41 and 42 are operated simultaneously by a single control knob 81. The control knob 81 is positioned at the forward end of the knee pad 35 along the longitudinal centerline of the kneeboard so that the control knob is located just in front of the knees of the user and between the knees. The user can therefore conveniently operate the control knob by reaching in front of his knees without looking behind him, and the position of the fins can be conveniently controlled simply by rotating the control knob to unlock the cable slide, moving the control knob to the desired position, and rotating the control knob to lock the cable slide. The control knob can be operated with one hand while the user holds the tow rope with the other hand, and the position of the fins can be changed while the user is being towed.

In one specific embodiment the cable slide 79 was molded from nylon, the operating knob 81 and the mounting bracket were molded from glass-filled nylon, the fins were molded from polycarbonate, and the channel bracket 72 was aluminum.

While in the foregoing specification, a detailed description of a specific embodiment of the invention was set forth for the purpose of illustration, it will be understood that many of the details herein given may be varied considerably by those skilled in the art without departing from the spirit and scope of the invention.

I claim:

1. A kneeboard comprising an elongated body having top and bottom surfaces and front and rear end portions, a fin movably mounted in the rear end portion of the body, the fin being movable between a lowered position in which it extends downwardly below the bottom surface of the kneeboard and a raised position, and operating means mounted on the front end portion of the body for moving the fin from its lowered position to its raised position, the operating means comprising a channel-shaped bracket mounted in the body, a slide slidably positioned within the channel, a knob positioned above the channel, and locking means on the knob for engaging the slide and retaining the slide in a desired position within the channel, the cable being secured to the slide, whereby movement of the slide within the channel retracts the fin from its lowered position toward its raised position.

2. The kneeboard of claim 1 in which the fin is pivotally mounted within the body, and a cable connected to the operating means and the fin for pivoting the fin from its lowered position to its raised position.

3. The kneeboard of claim 2 including a spring for resiliently biasing the fin toward its lowered position.

4. The kneeboard of claim 1 in which said locking means comprises a disc position within the channel and connected to the knob, and a cam on the disc and on the slide whereby rotation of the knob forces the slide against the channel.

5. A kneeboard comprising an elongated body having top and bottom surfaces and forward and rearward ends, a strap attached to the upper surface of the kneeboard for engaging the legs of a user, a pair of fins pivotally mounted within the body adjacent the rear end thereof, each fin being pivotal between a lowered position in which it extends downwardly below the bottom surface of the kneeboard and a raised position, operating means mounted on the body forwardly of the strap for moving the fins from their lowered positions to their raised position, and a pair of cables connected to the operating means, each of the cables being connected to one of the fins whereby said operating means simultaneously pivots both of said fins from their lowered positions to their raised positions.

6. The kneeboard of claim 5 in which each of the fins is pivotally mounted within the body, and a spring operatively associated with each fin for resiliently biasing the fin toward its lowered position.

7. A kneeboard comprising an elongated body having top and bottom surfaces and forward and rearward ends, a strap attached to the upper surface of the kneeboard for engaging the legs of a user, a pair of fins movably mounted within the body adjacent the rear end thereof, each fin being movable between a lowered position in which it extends downwardly below the bottom surface of the kneeboard and a raised position, operating means mounted on the body forwardly of the strap for moving the fins from their lowered positions to their raised positions, and a pair of cables connected to the operating means, each of the cables being connected to one of the fins whereby said operating means simultaneously moves both of said fins from their lowered positions to their raised positions, the operating means comprising a channel-shaped bracket mounted in the body, a slide slidably positioned within the channel, a knob positioned above the channel, and locking means on the knob for engaging the slide and retaining the slide in a desired position within the channel, the cables being secured to the slide whereby movement of the slide within the channel retracts the fins from their lowered toward their raised positions.

8. The kneeboard of claim 7 in which said locking means comprises a disc position within the channel and connected to the knob, and a cam on the disc and on the slide whereby rotation of the knob forces the slide against the channel.

9. The kneeboard of claim 7 including a pair of cable housings secured to the body, each of the cable housings extending within the body between the top and bottom surface from one of the fins to the operating means, each of the cables extending through one of the cable housings.

10. A kneeboard comprising an elongated body having top and bottom surfaces and front and rear end portions, a strap attached to the upper surface of the kneeboard for engaging the legs of a user, a fin pivotally mounted within the body adjacent the rear end thereof, the fin being pivotal between a lowered position in which it extends downwardly below the bottom surface of the kneeboard and a raised position, operating means mounted on the body forwardly of the strap for pivoting the fin from its lowered position to its raised position, a cable housing secured to the body and extending within the body between the top and bottom surfaces from the fin to the operating means, a cable extending through the cable housing and attached to the fin and to the operating means, whereby the operating means can move the cable and the fin.

11. The kneeboard of claim 10 including a spring for resiliently biasing the fin toward its lowered position.

* * * * *